US008272336B2

(12) United States Patent
Rutz

(10) Patent No.: US 8,272,336 B2
(45) Date of Patent: Sep. 25, 2012

(54) LOCKING MECHANISM

(75) Inventor: Josef Rutz, Rosenheim (DE)

(73) Assignee: Steelcase Werndl AG, Rosenheim (DE)

( * ) Notice: Subject to any disclaimer, the term of this patent is extended or adjusted under 35 U.S.C. 154(b) by 203 days.

(21) Appl. No.: 12/777,530

(22) Filed: May 11, 2010

(65) Prior Publication Data

US 2010/0300242 A1 Dec. 2, 2010

(30) Foreign Application Priority Data

May 27, 2009 (EP) ..... 09007081

(51) Int. Cl.
*A47B 3/00* (2006.01)

(52) U.S. Cl. ..... 108/115; 108/128

(58) Field of Classification Search ..... 108/115, 108/6, 8, 132, 127, 129, 124; 248/188.6
See application file for complete search history.

(56) References Cited

U.S. PATENT DOCUMENTS

| | | | | |
|---|---|---|---|---|
| 3,641,946 | A * | 2/1972 | Charnay | 108/6 |
| 5,890,436 | A | 4/1999 | Thompson | |
| 5,927,214 | A * | 7/1999 | Schwartz et al. | 108/128 |
| 6,845,723 | B2 * | 1/2005 | Kottman et al. | 108/132 |
| 7,546,810 | B2 * | 6/2009 | Hernandez | 108/115 |
| 7,703,400 | B2 * | 4/2010 | Mockel | 108/115 |
| 7,836,833 | B2 * | 11/2010 | Kumazawa | 108/115 |
| 7,845,290 | B2 * | 12/2010 | Piretti | 108/115 |
| 7,878,128 | B2 * | 2/2011 | Watson et al. | 108/115 |
| 8,051,784 | B2 * | 11/2011 | Hsu | 108/115 |
| 8,051,785 | B2 * | 11/2011 | Lin | 108/115 |
| 2005/0252426 | A1 * | 11/2005 | Blasen et al. | 108/91 |
| 2006/0230991 | A1 * | 10/2006 | Piretti | 108/115 |
| 2007/0261611 | A1 * | 11/2007 | Kumazawa | 108/115 |
| 2008/0295742 | A1 * | 12/2008 | Henriott | 108/6 |
| 2009/0114130 | A1 | 5/2009 | Chirea et al. | |
| 2009/0283021 | A1 * | 11/2009 | Wong | 108/116 |
| 2011/0139042 | A1 * | 6/2011 | Korb | 108/115 |

FOREIGN PATENT DOCUMENTS

| | | |
|---|---|---|
| DE | 27 46 922 | 11/1982 |
| DE | 195 01 567 | 2/1997 |
| DE | 20 2006 003 762 | 7/2007 |
| EP | 0 572 770 | 1/1997 |
| EP | 1 159 887 | 10/2003 |
| EP | 1 308 109 | 8/2004 |
| EP | 1 836 926 | 6/2009 |
| GB | 08602 | 0/1908 |
| GB | 833 472 | 4/1960 |
| GB | 1127989 | 9/1968 |

* cited by examiner

*Primary Examiner* — Jose V Chen
(74) *Attorney, Agent, or Firm* — Nixon & Vanderhye P.C.

(57) ABSTRACT

A locking mechanism, in particular for locking a table top in the work position thereof and for releasing the table top in order to pivot it for example into an approximately vertically extending storage position, is distinguished in that the locking mechanism comprises between the fully locked position and the fully released position at least one intermediate position, in which the table top is pivotable only through a restricted angular range in a manner delimited by stops.

11 Claims, 11 Drawing Sheets

LOCKING MECHANISM

This application is claims priority to EP Application No. 09007081.4 filed 27 May 2009, the entire contents of which is hereby incorporated by reference.

The invention relates to a locking mechanism.

For example, EP 0 572 770 B1 and EP 1 159 887 B1 each disclose a folding table, comprising T-shaped bases which are arranged at the end face and support a work surface or table top. This table top is conventionally oriented horizontally in a work and use position.

This work surface or table top can be pivoted between the conventional, approximately horizontally oriented work and use position and an approximately vertical storage position.

A locking mechanism is therefore provided and fixes the work surface in the conventional, approximately horizontal use position thereof. By contrast, if the work surface is to be pivoted into a space-saving storage position, the locking mechanism is actuated in such a way that said surface can be pivoted about a horizontal pivot axis into the approximately horizontal storage position thereof.

The object of the present invention is to provide a locking mechanism which is improved by comparison with the known solution.

It is conventional to use a locking mechanism which for example comprises an actuation means having a locking and release means, which cooperates with a catch means pivotable relative thereto, generally a locking and retaining means. Thus, in other words, the locking and release means may for example be pivoted together with the table top or a support means which supports the table top, if for example the catch means is held on the stand means of the table, i.e. on the bases, so as not to rotate together with the table top. It would also be possible, in a kinematic reversal, for the locking and retaining means, sometimes referred to as a catch means, to be fastened at least indirectly to the table top and pivotable together therewith, whilst the locking and release means is held on the stand base means so us to be non-rotatable relative to the table top.

Whilst in the prior art solutions the table top is held fixed and then the locking mechanism suddenly ceases to be effective when the locking and release means is actuated, with the result that the table top can now be pivoted fully through approximately 90° into the storage position thereof, the invention proposes a different mode of operation. According to the invention, it is provided that after the start of the release process of the locking and release means, and before the fully released position of the locking and release means is reached, an intermediate position is reached, in which the table top can be pivoted for example only through a few degrees, in a manner delimited by stops. This offers unexpected advantages over the current solution. if someone had forgotten to clear the table top completely of objects located thereon (possibly cups, glasses etc. located on the table top), this would result in the table top being fully pivotable about the horizontal axis thereof once the locking means had been released, i.e. it would start to rotate immediately, and all the items located thereon would fall off. The invention now ensures that once an intermediate position has been reached, the table top can be pivoted only through a few degrees, in a manner delimited by stops, in such a way that at this point, objects still located on the table top cannot immediately slip or fall off.

The solution according to the invention consists in the locking and release means, when actuated, reaching an intermediate position during the release process thereof from the locked position, in which intermediate position a limited play comes into effect, which can be pre-selected appropriately depending on the construction and which only allows the table top to pivot through a few degrees.

It would also be possible, instead of allowing this play to come into effect via stops after a particular intermediate position has been reached, to configure the locking and release means in such a way that the set play increases continuously between the fully locked position and the fully released position on the release path, and not in a single step. With increasing unlocking of the locking and release means, the table top can be adjusted through an increasingly large angular range, in a manner delimited by stops, until the locking mechanism is fully released.

Finally, combinations of the two above-mentioned variants are possible, in which once an intermediate position is reached, an intermediate position delimited by stops remains unchanged over a relatively longer release path or the relevant play first slowly increases and then remains unchanged etc.

The invention is explained in greater detail in the following by way of drawings, in which, specifically:

FIG. 1*a* is an end view of a folding table according to the invention

FIG. 1*b* is a longitudinal side view of a detail of the folding table according to the invention, with the support column arrangement arranged at the right-hand end of the table;

FIG. 2 is an end view, comparable to FIG. 1, of the table according to the invention, in which the table top has been pivoted to the right into the storage position thereof;

FIG. 3*a* is an end view comparable to FIG. 3*a*, but in which the table top is pivoted into the opposite storage position;

FIG. 3*b* is a rear view of part of the folding table shown in FIG. 4*a* with the work surface folded into the storage position;

Figure 6C:
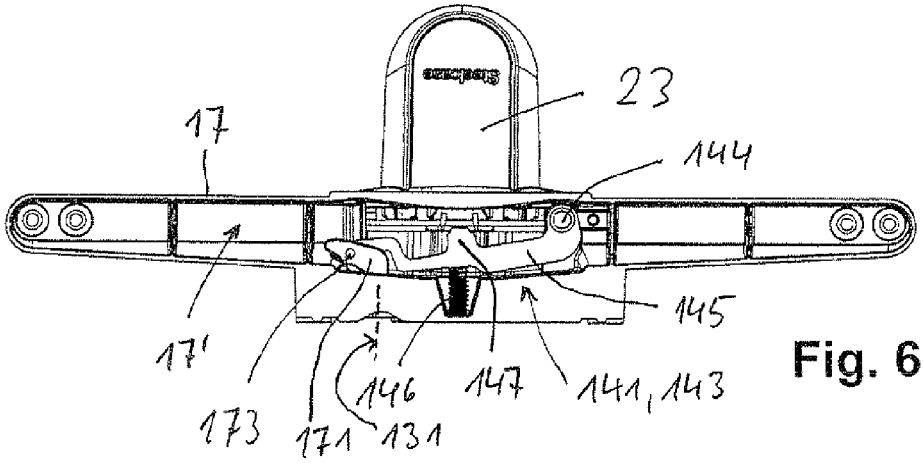
Figure 6B:
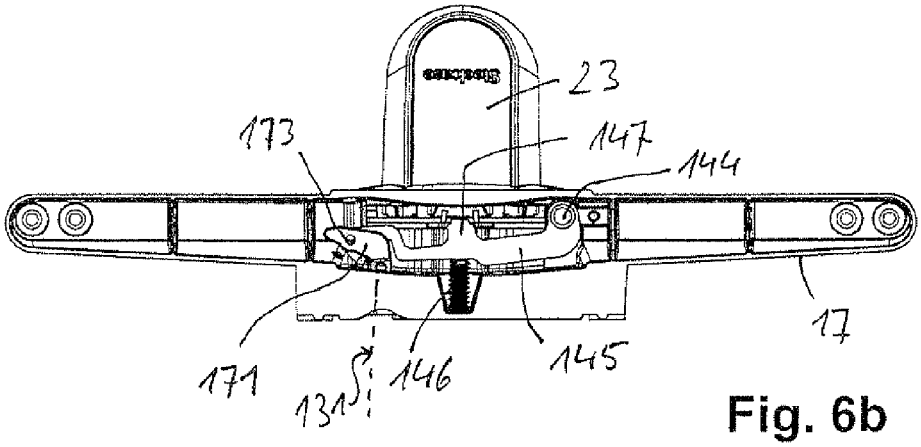
Figure 6A:
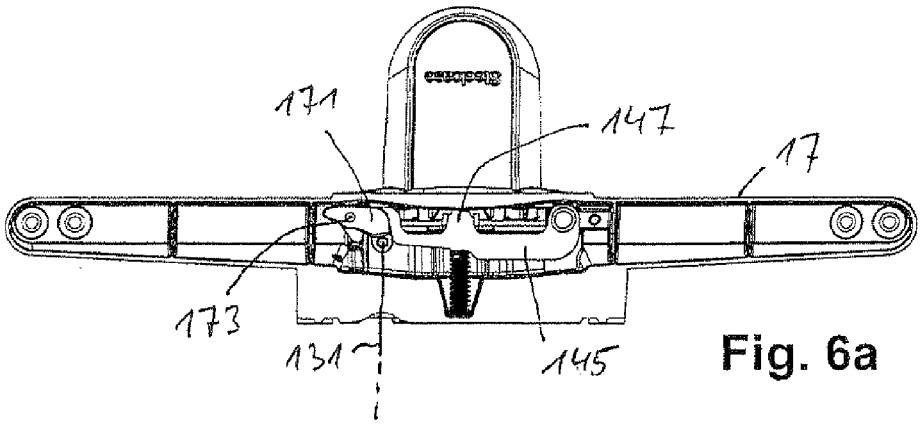
Figure 7C:
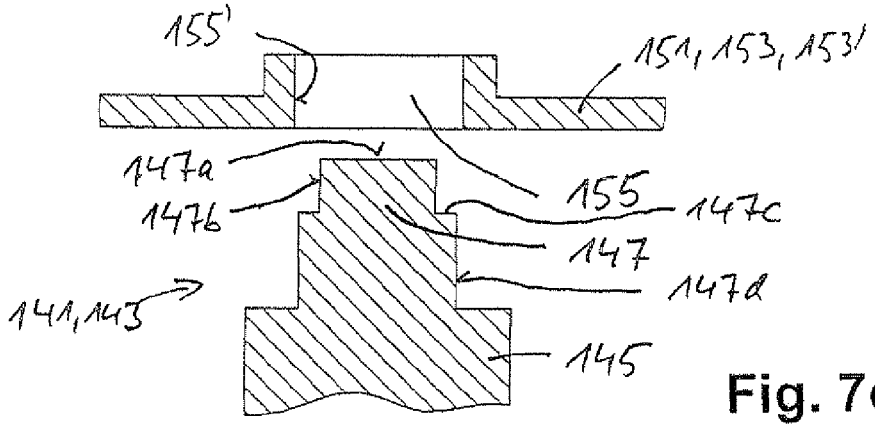
Figure 7B:
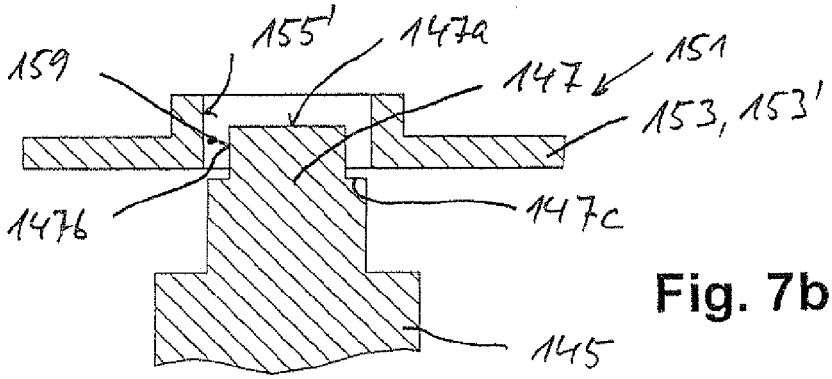
Figure 7A:
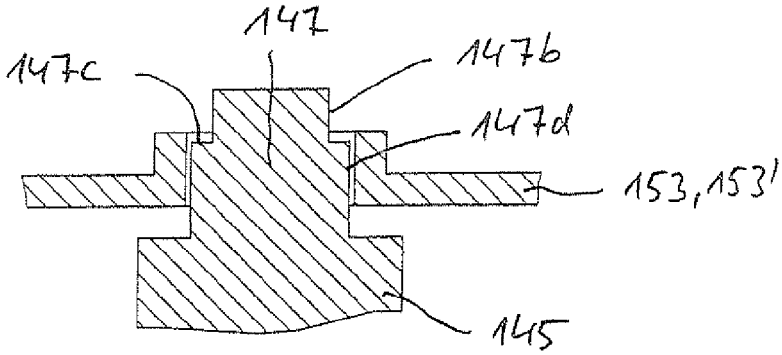

FIG. 6*a*-6*c* are three plan views of the locking mechanism according to the invention in the locked position, an intermediate position and the final released position;

FIG. 7*a*-7*c* are corresponding schematic views illustrating the mode of operation in FIG. 7*a*-7*c;*

Figure 8C:
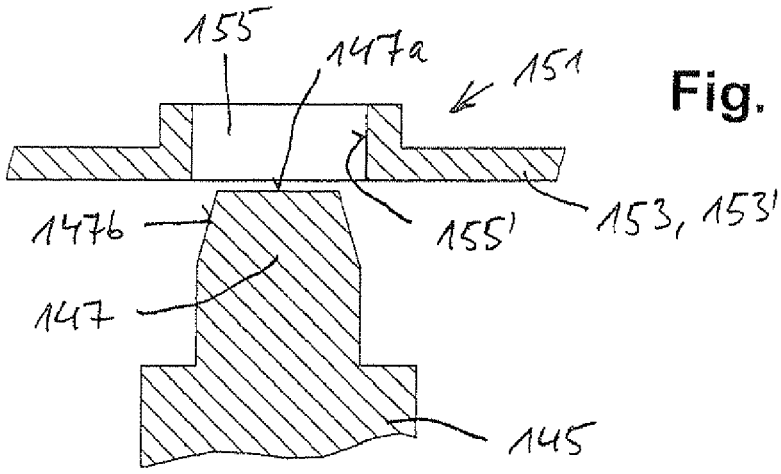
Figure 8B:
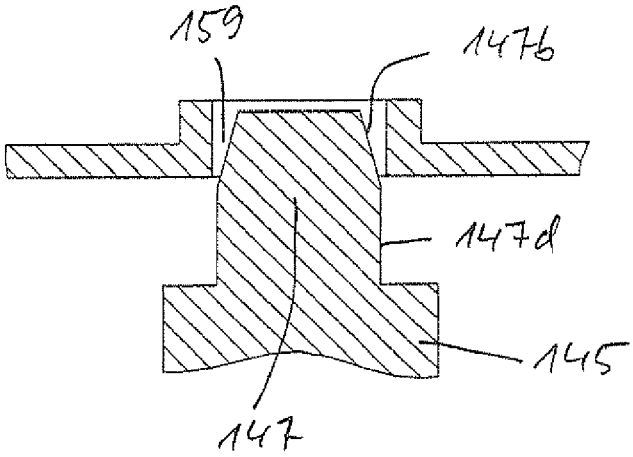
Figure 8A:
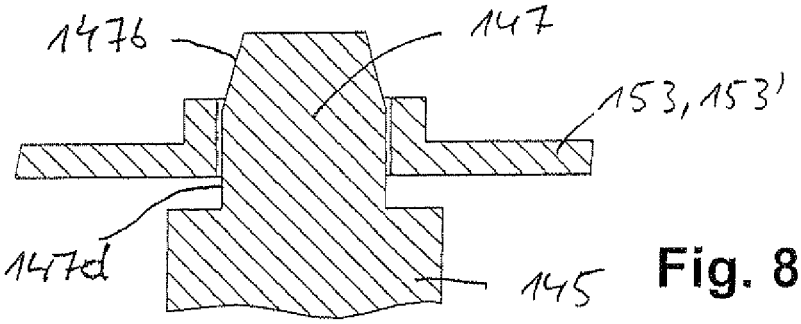
Figure 10:
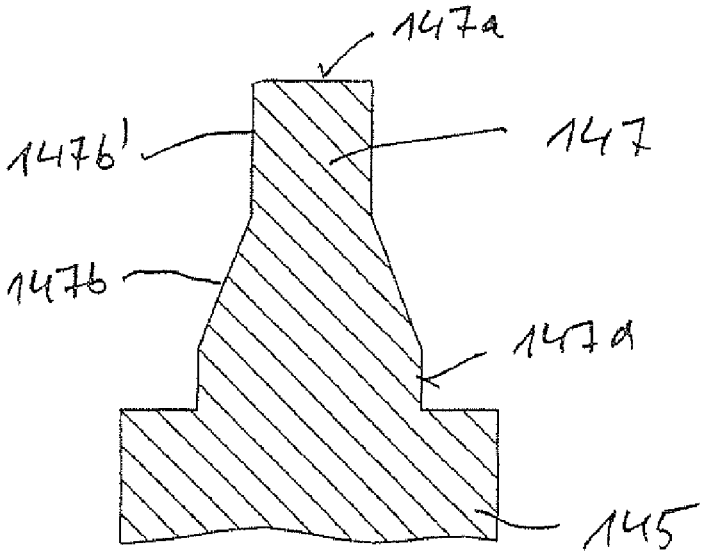
Figure 9:
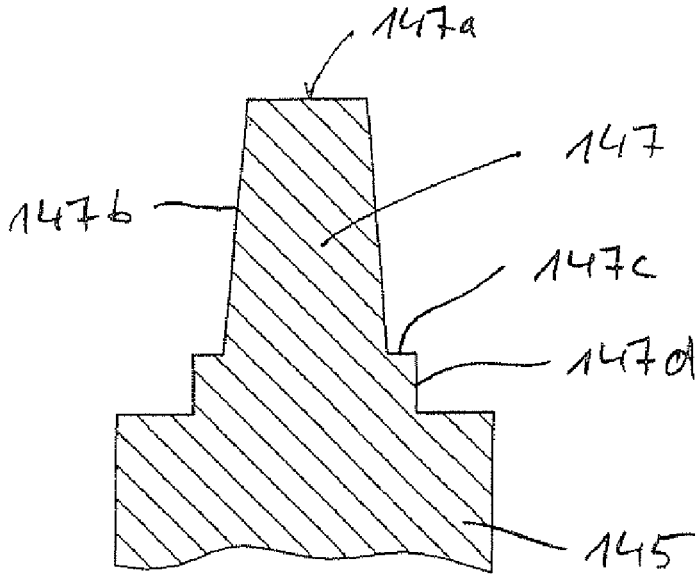

FIG. 8*a*-8*c* show an embodiment modified from that of FIG. 7*a*-7*c* and having a different form of catch pin;

FIG. 9 is a schematic side view of a further modified embodiment for a catch pin according to the invention; and FIG. 10 shows an embodiment further modified from FIG. 9.

Figure 1A:
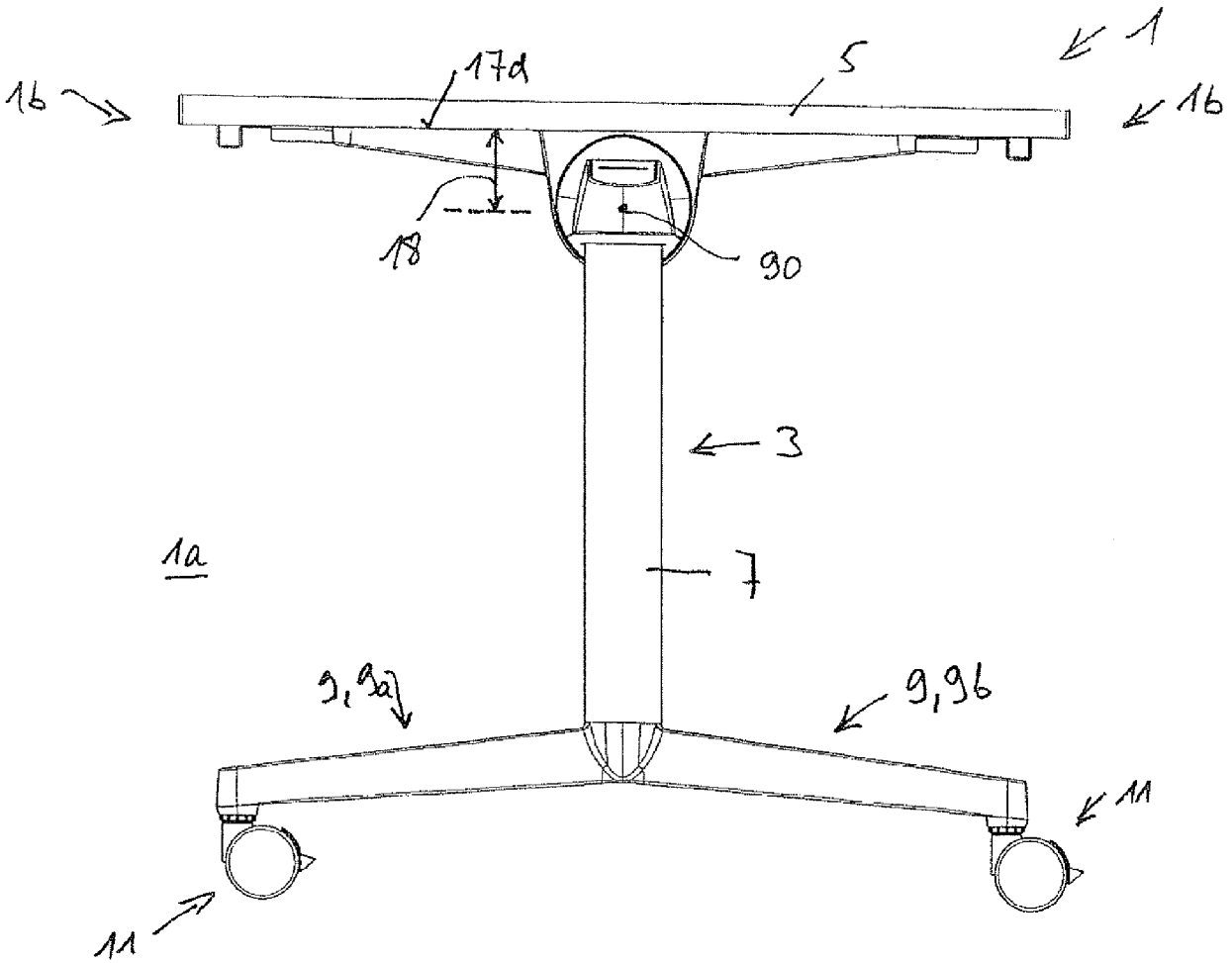
Figure 1B:
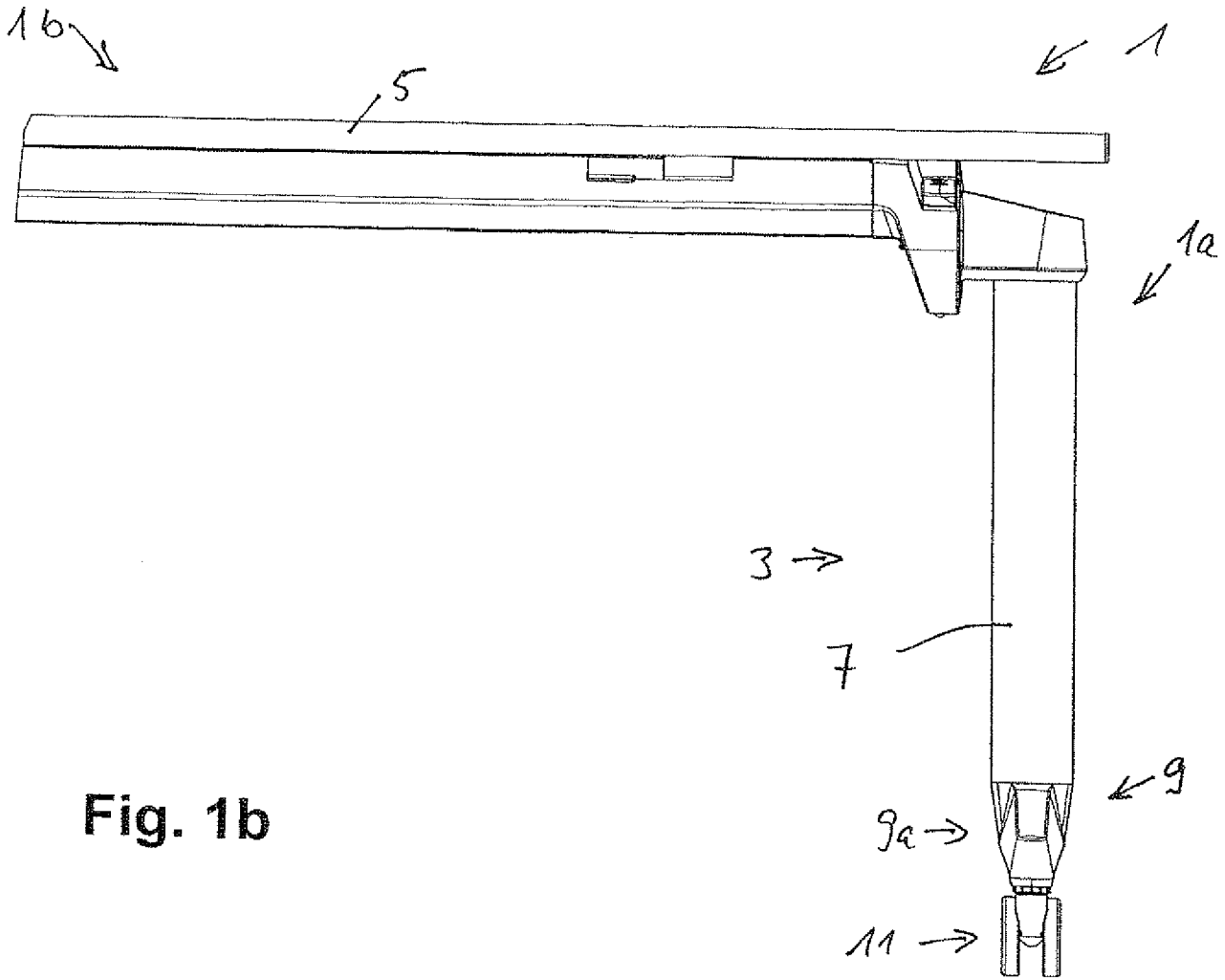

FIG. 1*a* shows for example the right-hand end face 1*a* of a folding table 1. FIG. 1*b* is the right-hand part of one longitudinal side 1*b* of the table 1, showing the support means 3 which is arranged on the right in this view.

It can be seen from the drawings that the folding table 1 comprises an upwards-facing table top 5, which in FIG. 1*a* and 1*b* is located in the generally horizontally oriented work position thereof.

The support means 3 is provided at each of the two opposite end faces 1*a* and in the embodiment shown comprises a respective support column 7, which transitions downwards into a support base 9, which comprises support base portions 9*a* and 9*b* projecting on either side of the support column 7.

A roller arrangement 11 is provided on each of the opposite ends of the support bases 9 and is conventionally provided with a fixing or releasing mechanism. This means that the folding table can be moved for various uses or storage positions without difficulty. In each desired work position it can be ensured, by actuating the locking mechanism integrated into the rollers, that the table is not moved accidentally.

Figure 2:
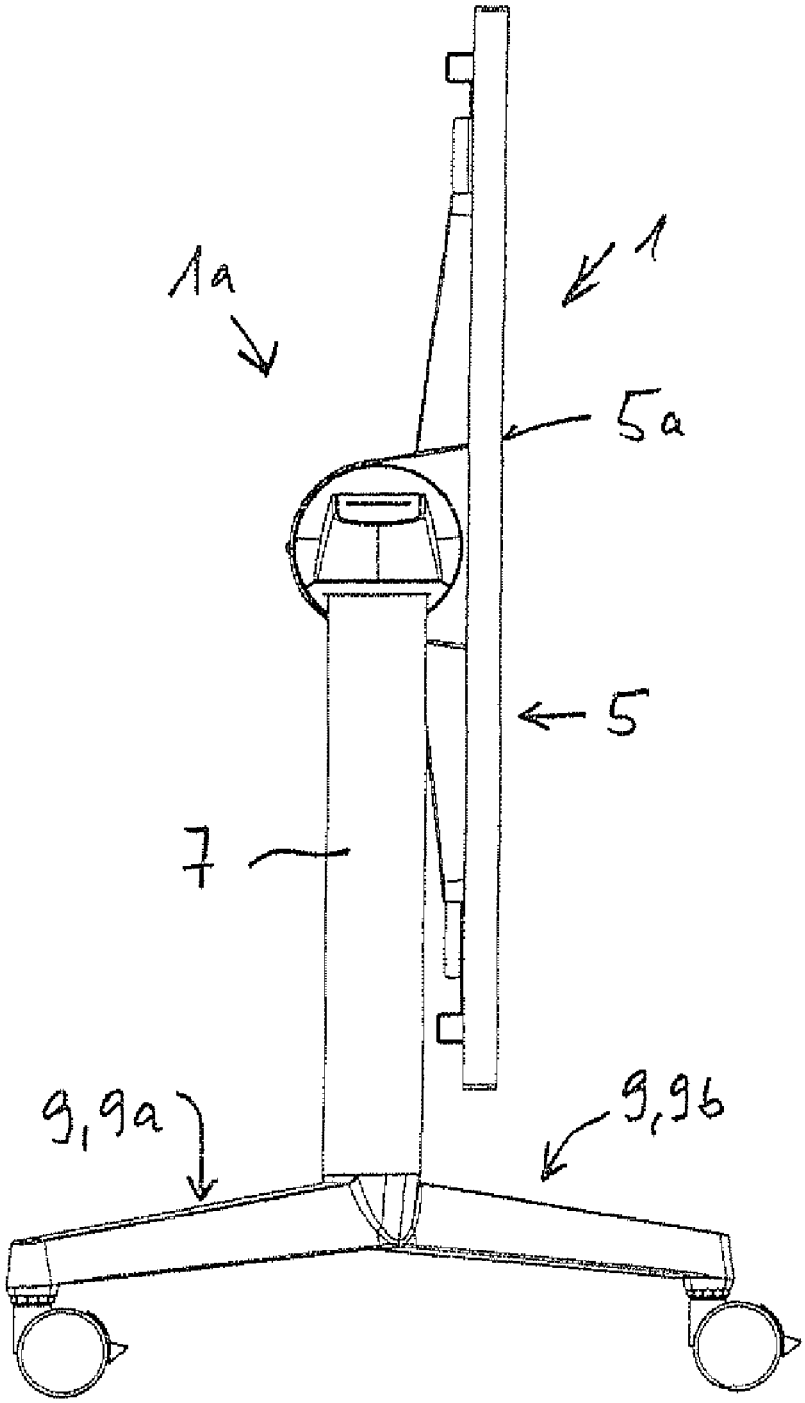

FIG. 2 reproduces the right-hand end face 1*a* of the table as shown in FIG. 1, with the table top brought into the vertically extending storage position arranged on the right.

Figure 3A:
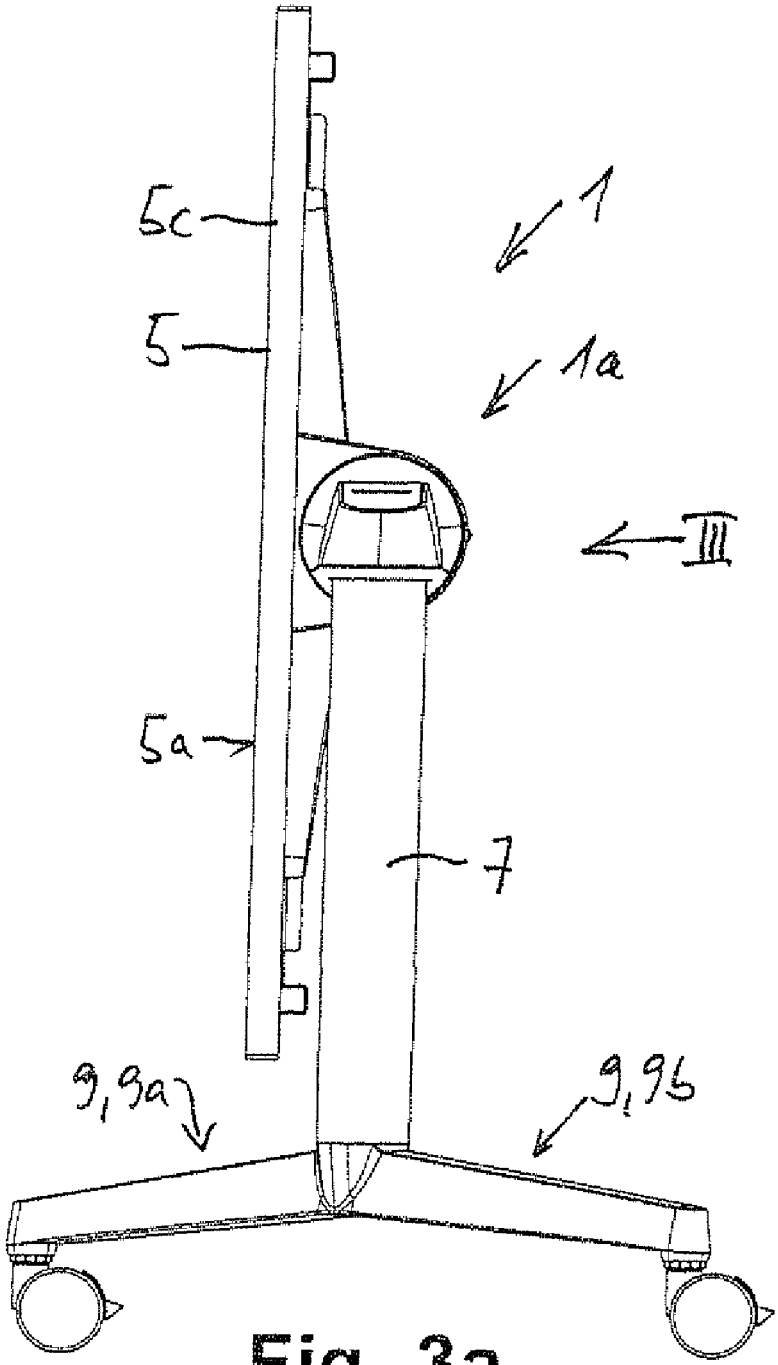
Figure 3B:
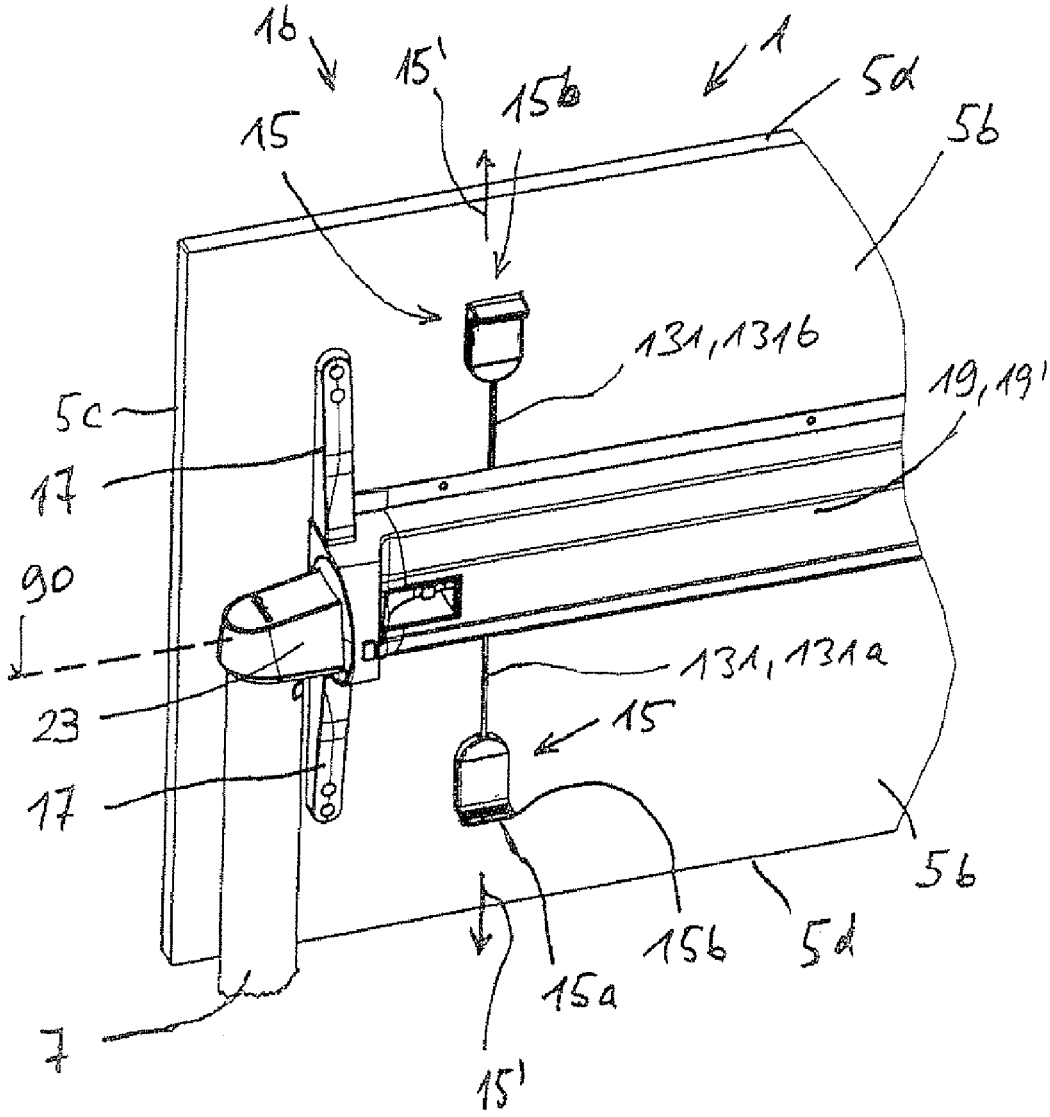

In FIG. 3*a*, by contrast with FIG. 2, the table top 5 has been brought into the opposite pivot position, and FIG. 3*b* is a rear view, in the direction of the arrow III shown in FIG. 3*a*, of part of the underside 5*b* of the table top 5 when folded into the storage position.

So that the work surface can be folded into the storage position around a horizontal pivot axis 90 (FIG. 3*b*) from either longitudinal side 1*b* of the folding table 1, a disengagement and/or actuation mechanism 15 is provided on the two opposite longitudinal sides 1*a* of the folding table on the underside 5*b* of the table top 5 (FIG. 3*b*). If this disengagement and/or actuation mechanism 15 is for example pulled in the direction of the arrow 15' towards the adjacent longitudinal edge 5*d* of the table top 5 (specifically by gripping an associated handle portion on the actuation means 15), this releases a locking mechanism (described in greater detail below) in such a way that a table top located in the work position can then be folded into the storage position, pivoted through 90°, thereof or vice versa. It can be seen from FIG. 3*b* that for example two actuation means 15*a* and 15*b* are provided, one actuation means being arranged alongside one longitudinal edge 5*d* and the other actuation means being arranged alongside the opposite longitudinal edge 5*d* on the underside of the table top, in such a way that it is possible from either side to grip a corresponding actuation means 15 and thus to carry out the desired adjustment.

As can be seen from the drawings, a two-armed table top support 17, extending parallel to the end face 5*c* of the table top 5 in the embodiment shown, is provided offset inwardly on the underside 5*b* of the table top 5, in each case in the end face region of the end face 5*c* of the table top 5, and is screwed onto the underside 5*b* of the table top 5 using screws for example.

A trough 19 is fixed to the underside of the table top, between the two two-armed table top supports 17 arranged alongside the end edges 5*c* of the table top 5, and acts as a cable channel 19'.

Figure 4:
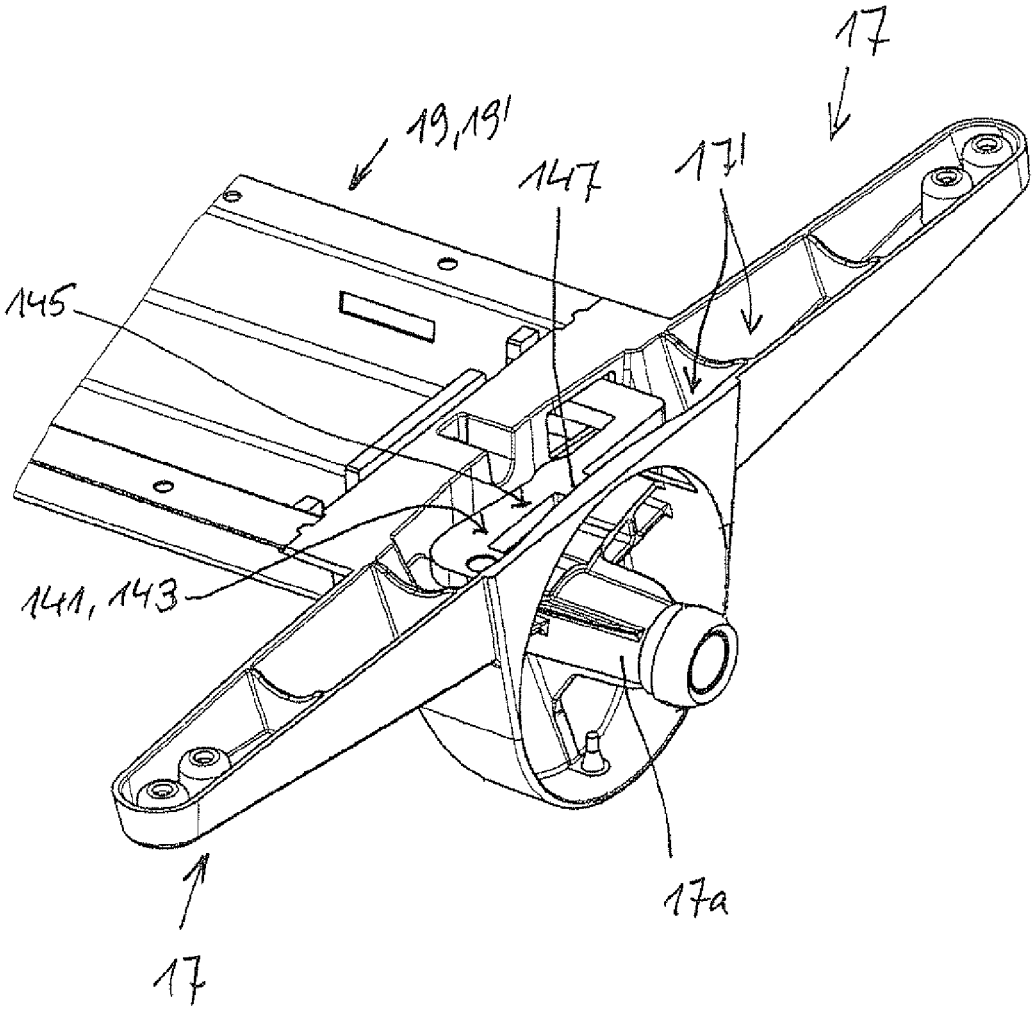
FIG. 4 is a three-dimensional view of a detail of a two-armed table top support having an associated hollow shaft and a mounted bevel gear fixed in rotation therewith, adjacent to a cable channel.

The two-armed table top support 17 transitions—as can be seen in particular from the three-dimensional detail according to FIG. 4—into a hollow shaft 17*a*, which lies at a predetermined distance 18 below the upwards-facing construction plane 17*d* (FIG. 1*a*) of the two-armed table top support 17, the underside of the table top 5 being laid on said plane and fixed to the table top support. The aforementioned distance 18 between the underside of the table top 5 and the horizontal pivot or tilt axis 121 extending centrally through the hollow shaft 17*a* is of a sufficient size to travel past the respective stand means in the form of support columns, i.e. past the support columns 7, when the table top 5 is pivoted into one of the two opposed storage positions (in which the table top is suspended oriented more or less vertically).

An axle 21 (FIG. 5) engages in this hollow shaft 17*a* and is braced rigidly in a bracing head 23, which is in turn supported directly on the upper end of the support column 7.

This provides the possibility of the two-armed table top support 17 being pivoted together with the table top 5, in each case around the non-rotating axle member 21 from the upwards-facing, approximately horizontal work position into one of the two mutually opposed storage positions, in which the work surface is oriented more or less in the vertical direction.

The table top is to be locked, at least in the single work position thereof, conventionally in the horizontal position, by a locking mechanism mentioned above, in such a way that pivoting is reliably prevented.

For this purpose, the locking mechanism comprises a furniture adjustment means 141, in the present embodiment specifically in the form of a locking and release means 143, which comprises on the one hand a pivotable locking and/or retaining means 151 having a catch pin 147, and on the other hand a catch means 153, which is formed as a locking disc 153' in the present embodiment.

Figure 5:
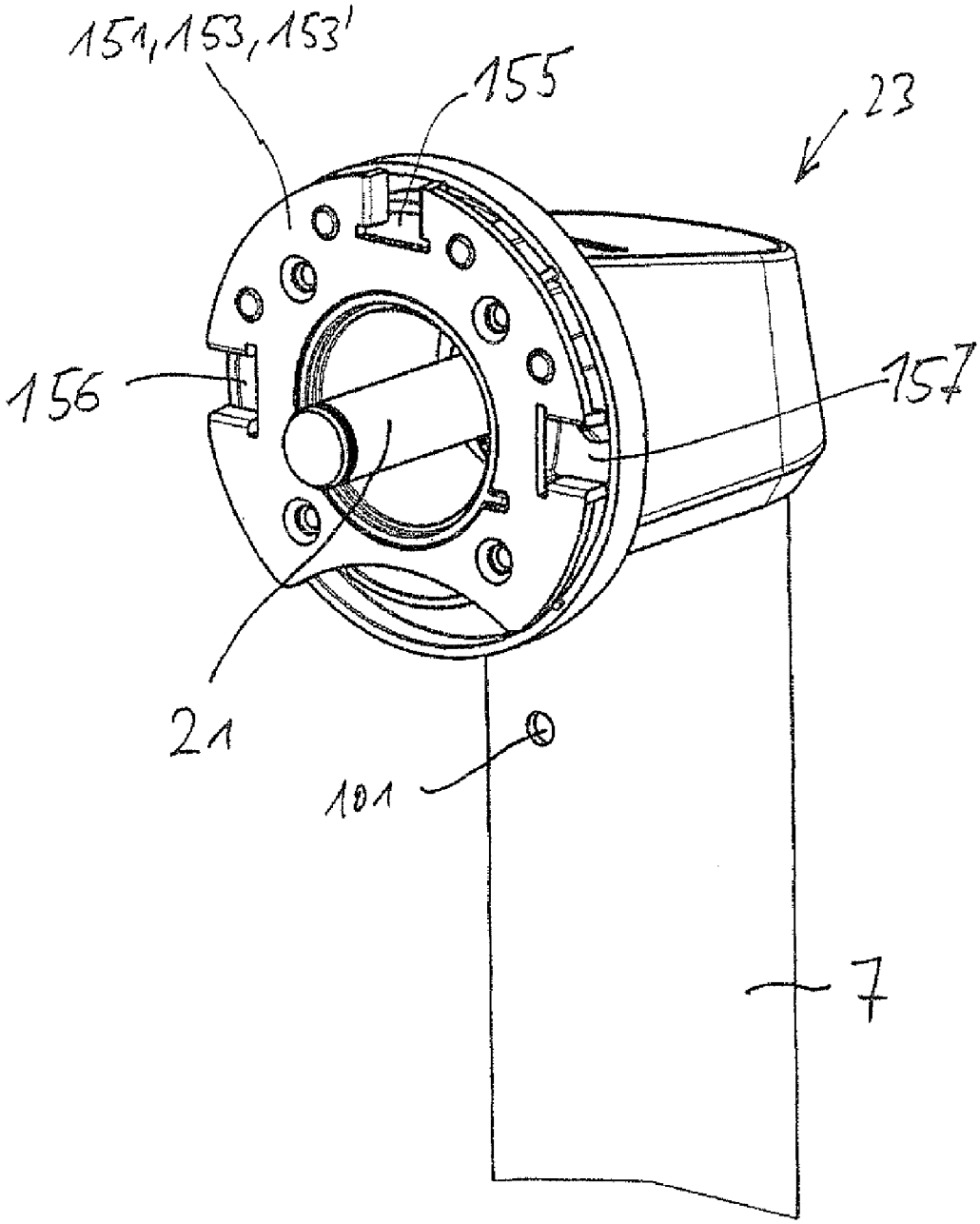
FIG. 5 is a three-dimensional schematic view of a bracing and supporting head with associated ratchet wheel and fixed axle.

As can be seen from FIG. 5, the locking disc 153' comprises three catch recesses 155, 156 and 157, mutually offset in the circumferential direction, the first catch recess 155 being arranged in the vertically upwards-facing position and the catch recesses 156, 157 being arranged in the horizontal position, diametrically opposite relative to the horizontally oriented axle 21.

In the embodiment shown, the locking disc 153' is preferably screwed onto the bracing and retaining head 23 and thus held fixed axially and above all radially. The aforementioned recesses 155, 156, 157 which are offset in the circumferential direction may, depending on the catch position, be penetrated by an axial catch pin 147 (FIG. 4), which is part of the actuation means 141 or is positioned thereon. The actuation means 141 having the locking and release means 143 and having the catch pin 147 which is formed or positioned thereon may for example be held in a recess 17' of the two-armed table top support 17 so as to be displaceable and pivotable.

FIGS. 6*a*, 6*b* and 6*c* therefore show the locking and release means 153 in greater detail, specifically in a locked position (FIG. 6*a*), in an intermediate position between the fully locked position and the fully released position (FIG. 6*b*) and in a fully released position (FIG. 6*c*), in which the locking mechanism is fully unlocked and the table top can be rotated in one or in the other, opposite direction through approximately 90° into the vertical storage position thereof.

Pivoting of the table top can be enabled via the actuation mechanism 15 mentioned above in connection with FIG. 3*b* by pulling this actuation mechanism, whereby a locking and release lever 145 (shown in FIG. 6*a* to 6*c* and forming part of the locking and release means 143) can be pivoted anticlockwise about a vertical pivot axis 144 from the locked position in FIG. 6*a* into the fully released position of FIG. 6*c*, against the force of a supported spring means 146, by means of a Bowden cable or a wire cable or another transmission means 131.

As is evident from the embodiment, the locking and release means 143 comprises, in the axial insertion direction and preferably in the form of a locking and release pin 147, a portion 147*b* which is tapered towards the free end 147*a* of the locking and release pin 147 and which extends from the front end 147*a* over part of the length of the pin 147 and then transitions via a stepped shoulder 147*c* into a locking portion 147*d* of a greater diameter.

It is constructed in such a way that in the fully locked position of FIG. 6*a*, the locking portion 147*d* cooperates with the delimitation 155' of the first catch recess 155 completely without play, i.e. lies against said delimitation. Thus, the table top is retained in a rigidly locked manner, completely without play, and cannot be pivoted.

The construction and mode of operation in this case are also shown schematically in FIG. 7*a* to 7*c*, parallel to FIG. 6*a* to 6*b*.

If the table top is now to be pivoted into the storage position thereof, the actuation means must be disengaged using the aforementioned actuation handle 15, i.e. be pulled by this handle, in such a way that the aforementioned locking and release lever 145 is pivoted accordingly via the transmission mechanism 131. This causes the locking and release pin 147 to be moved slowly and axially out of the catch recess 155. When the stepped shoulder 147*c* reaches the delimitation 155' of the catch recess 155, the locking and release lever 145 can be pivoted by the play 159, thus preset, through a few degrees in one or the opposite direction, i.e. can be pivoted in a manner delimited by stops. The aforementioned play 159 is brought about by the distance between the tapered portion 147*b* of the locking and release pin 147 and the diameter opening between the opposite delimitations 155' of the catch recess 155. If there are still objects on the table at this point, this may become clear to the operator directly, by way of a brief sliding movement or the like, in such a way that he can keep holding the table top or release the actuation means again for unlocking.

If there are no objects on the table, then the actuation means can be actuated further, in such a way that the locking and release lever 145 and thus the catch pin 147 are pulled out further from the first catch recess 155 in the axial direction. Once the front end 147*a* of the locking and release lever 145 leaves the catch recess 155, from then on the table top 5 can be pivoted without restrictions, i.e. fully, until it attains the approximately vertically extending storage position thereof.

In the embodiment shown, transmission of force is also provided, for which purpose the locking and adjustment lever 145 cooperates with a force transmission lever 171, which is connected to the locking and release lever 145 via a vertical tilt axis 173. In the embodiment shown, the transmission means 131 engages directly on this force transmission lever 171, offset from the tilt axis 173. Alternatively, the transmission means 131 could preferentially be positioned directly or indirectly on the locking and release lever 145, at the free end.

A slightly modified embodiment will be described in the following with reference to FIG. 8*a* to 8*c*, in which as in FIG. 7*a* to 7*c* the locking mechanism is merely shown schematically.

In the variant of FIG. 8*a*, the locking and release engagement member 147 is formed so as to be slightly conically tapered in the engagement direction, i.e. towards the front end 147*a* (conical or wedge-shaped, generally tapering portion 147*b*). In the locked position shown in FIG. 8*a*, a corresponding portion 147*a* of the outer circumference of this pin 147 thus lies on the delimitation 155' of the recess 155.

If the actuation means 15 is now actuated against the force of the spring means, this results in increasingly large play 159 corresponding to the distance by which the pin 147 has already been pulled out from the catch recess 155. The size of this play 159 defines the maximum possible pivot movement, delimited by stops, of the table top. Once the end 147*a* has left the catch recess 155, the table can be fully pivoted (FIG. 8).

For the drawing of FIG. 9, a variant has been selected in which the locking pin 147 startingly transitions via a stepped shoulder 147*c* into a tapered portion 147*b*, which then however, instead of having a constant diameter until the front end 147*a*, tapers increasingly up to the end 147*a* thereof. During pivoting, the play 159 is thus startingly increased accordingly when the step 147*c* is reached, this play 159 still becoming increasingly large in accordance with the (conically) tapered portion 157*b* as the release process of the locking means continues, until the final released position is reached.

Referring to FIG. 10, a combined variant has been selected, which is similar to the above-mentioned embodiment but in which in the insertion direction, the catch pin 147 first tapers approximately conically over a particular length of the insertion path thereof (portion 147*b*) and then transitions into a portion with a constant diameter (portion 147*b'*). In the release process, the play 159 is first increased until reaching the portion of the pin where the conically tapering pin portion transitions into the pin portion of constant diameter 147*e*. As the release process of the locking mechanism continues, the play 159 remains unaltered at first, until the pin has fully left the catch recess. Any desired variants are possible in this region.

It is also evident from the variants described in reference to FIGS. 9 and 10 that the catch pin 147 may also comprise a plurality of steps 147*c* offset in the axial direction, i.e. in the insertion direction, in such a way that the catch pin 147 may comprise a plurality of portions of differing external diameter. Each of the portions between the steps may thus comprise an equal outer diameter over its part of the length. However, it is also possible for the portions between the steps to decrease continually in the direction of the pin end in such a way that the play is altered in this region. Any desired variants are possible in this region.

It is further noted that the locking mechanism accordingly also acts in the vertical storage position of the table top 5. However, the significance of the possible play is of lesser importance during the unlocking process in this position.

It is evident from these descriptions that the size of the stop-delimited play can be defined and predetermined as a function of the size of the step 147*c* on the catch pin 147 or based on the tapering, produced over the catching or insertion length of the pin, of the pin cross-section. It has been found that the play in this case should be set in such a way that in the intermediate position, it is possible for the table top to pivot by less than ±20°, in particular less than ±18°, ±16', ±14°, ±12°, ±10°, ±8°, ±6°, ±4° or for example less than ±2°.

For completeness, it is also noted that the locking and release means 143 is preferably biased in the form of the locking and release lever 147 by the aforementioned spring means 146 into the locking and thus into the catch position. In other words, if the actuation means 15 is released, then the actuation means 15 and thus the locking means 143 are pivoted back into the catch position thereof via the corresponding spring means 146 or another alternatively or additionally provided spring means, as long as the catch pin 147 can engage in one of the catch recesses 155, 156 or 157.

The invention claimed is:

1. Locking mechanism for locking a table top in a work position thereof and for releasing the table top in order to pivot it into a storage position, the locking mechanism comprising:

a table top support securable to an underside of the table top;

a bracing head attachable to a support column, wherein the locking mechanism acts between the table top support and the bracing head;

an actuation means cooperable with the table top support and having a locking and release means; and a retaining means cooperable with the bracing head wherein when locked, the locking and release means cooperates with the retaining means such that the table top is held in the work position thereof without play, and wherein when the locking mechanism is released, the locking and release means is adjusted or pivoted relative to the retaining means such that the table top can be pivoted from the work position into the storage position thereof, the locking mechanism defining at least one intermediate position, in which the table top is pivotable only through a restricted angular range of at least a few degrees delimited by stops, wherein the locking and release means comprises a catch pin which cooperates with a catch recess, the size of which is delimited by a delimitation, wherein the catch pin comprises a first locking portion, which in the locked position cooperates with the delimitation of the catch recess without play, and wherein a stepped shoulder is attached to the first locking portion towards a front end of the first locking portion in an insertion direction, the locking pin transitions into a tapered portion of reduced diameter, a play being established by a distance between the tapered portion and the delimitation, defining the angular range within which the table top can be pivoted.

2. Locking mechanism according to claim 1, wherein after a second locking portion, the catch pin transitions towards the front end in the insertion direction, via the stepped shoulder, into a portion formed with a tapered diameter by comparison with the first locking portion and which tapers further, at least over part of the length thereof, towards the free end of the catch pin.

3. Locking mechanism according to claim 1, wherein the catch pin is positioned on a pivotable locking and release lever, and can be adjusted about a pivot axis against a force of a spring means.

4. Locking mechanism according to claim 1, wherein the angular range within which the table top can be pivoted, in a manner delimited by stops, before the final release of the locking and release means is less than ±20°.

5. Locking mechanism according to claim 1, wherein the angular range within which the table top can be pivoted, in a manner delimited by stops, before the final release of the locking and release means is less than ±2°.

6. Locking mechanism for locking a table top in a work position thereof and for releasing the table top in order to pivot it into a storage position, the locking mechanism comprising:

a table top support securable to an underside of the table top;

a bracing head attachable to a support column, wherein the locking mechanism acts between the table top support and the bracing head;

an actuation means cooperable with the table top support and having a locking and release means; and a retaining means cooperable with the bracing head wherein when locked, the locking and release means cooperates with the retaining means such that the table top is held in the work position thereof without play, and wherein when the locking mechanism is released, the locking and release means is adjusted or pivoted relative to the retaining means such that the table top can be pivoted from the work position into the storage position thereof, the locking mechanism defining at least one intermediate position, in which the table top is pivotable only through a restricted angular range of at least a few degrees delimited by stops, wherein the locking and release means comprises a catch pin which cooperates with a catch recess, the size of which is delimited by a delimitation, wherein the catch pin comprises a first locking portion, which in the locked position cooperates with the delimitation of the catch recess, without play, and wherein a tapering portion is attached to the first locking portion towards a front end of the first locking portion in an insertion direction, play being established by a distance between the tapered portion and the delimitation, defining the angular range within which the table top can be pivoted.

7. Locking mechanism for locking a table top in a work position thereof and for releasing the table top in order to pivot it into a storage position, the locking mechanism comprising:

a table top support securable to an underside of the table top;

a bracing head attachable to a support column, wherein the locking mechanism acts between the table top support and the bracing head;

an actuation means cooperable with the table top support and having a locking and release means; and a retaining means cooperable with the bracing head wherein when locked, the locking and release means cooperates with the retaining means such that the table top is held in the work position thereof without play, and wherein when the locking mechanism is released, the locking and release means is adjusted or pivoted relative to the retaining means such that the table top can be pivoted from the work position into the storage position thereof, the locking mechanism defining at least one intermediate position, in which the table top is pivotable only through a restricted angular range of at least a few degrees delimited by stops, wherein the locking and release means comprises a catch pin which cooperates with a catch recess, the size of which is delimited by a delimitation, wherein the catch pin, extending from a second locking portion, transitions into a portion which tapers increasingly towards the front end of the catch pin and to which a further portion of a constant diameter is attached.

8. Locking mechanism for locking a table top in a work position thereof and for releasing the table top in order to pivot it into a storage position, the locking mechanism comprising:

a table top support securable to an underside of the table top;

a bracing head attachable to a support column, wherein the locking mechanism acts between the table top support and the bracing head;

an actuation means cooperable with the table top support and having a locking and release means; and a retaining means cooperable with the bracing head wherein when locked, the locking and release means cooperates with the retaining means such that the table top is held in the work position thereof without play, and wherein when the locking mechanism is released, the locking and release means is adjusted or pivoted relative to the retaining means such that the table top can be pivoted from the work position into the storage position thereof, the locking mechanism defining at least one intermediate position, in which the table top is pivotable only through a restricted angular range of at least a few degrees delimited by stops, wherein in an insertion direction, a catch pin is divided up into various portions, which comprise one or more steps and/or one or more portions which taper towards an end and/or one or more portions of a constant external dimension.

9. Locking mechanism for locking a table top in a work position thereof and for releasing the table top in order to pivot it into a storage position, the locking mechanism comprising:

a table top support securable to an underside of the table top;

a bracing head attachable to a support column, wherein the locking mechanism acts between the table top support and the bracing head;

an actuation means cooperable with the table top support and having a locking and release means; and a retaining means cooperable with the bracing head wherein when locked, the locking and release means cooperates with the retaining means such that the table top is held in the work position thereof without play, and wherein when the locking mechanism is released, the locking and release means is adjusted or pivoted relative to the retaining means such that the table top can be pivoted from the work position into the storage position thereof, the locking mechanism defining at least one intermediate position, in which the table top is pivotable only through a restricted angular range of at least a few degrees delimited by stops, wherein the catch pin is positioned on a pivotable locking and release lever, and can be adjusted about a pivot axis against a force of a spring means, wherein the locking and release lever cooperates with a force transmission lever, to which it is connected about a pivot axis, a transmission means, which can be disengaged via a disengagement mechanism, being positioned on the force transmission lever.

10. Locking mechanism for locking a table top in a work position thereof and for releasing the table top in order to pivot it into a storage position, the locking mechanism comprising:

a support member securable to an underside of the table;

a locking pin cooperable with the support member, the locking pin being displaceable among a locked position, a released position, and an intermediate position; and a locking disc attachable to a support column and including at least one catch recess, the support member and locking pin being pivotable relative to the locking disc, wherein the locking pin fully engages the at least one catch recess in the locked position, partially engages the at least one catch recess in the intermediate position with play between the locking pin and the catch recess, and is disengaged from the at least one catch recess in the released position, and wherein in the intermediate position, the locking pin and the support member are rotatable relative to the locking disc and the support column only through at least a few degrees according to the play between the locking pin and the catch recess.

11. Locking mechanism according to claim 10, wherein the locking pin is biased into the locked position by a spring.

* * * * *